US009903172B2

(12) United States Patent
Hansen

(10) Patent No.: US 9,903,172 B2
(45) Date of Patent: Feb. 27, 2018

(54) SUBSEA SLANTED WELLHEAD SYSTEM AND BOP SYSTEM WITH DUAL INJECTOR HEAD UNITS

(71) Applicant: AARBAKKE INNOVATION A.S., Bryne (NO)

(72) Inventor: Henning Hansen, Dolores (ES)

(73) Assignee: AARBAKKE INNOVATION AS, Bryne (NO)

( * ) Notice: Subject to any disclaimer, the term of this patent is extended or adjusted under 35 U.S.C. 154(b) by 0 days.

(21) Appl. No.: 15/524,261

(22) PCT Filed: Nov. 10, 2015

(86) PCT No.: PCT/US2015/059804
§ 371 (c)(1),
(2) Date: May 3, 2017

(87) PCT Pub. No.: WO2016/081215
PCT Pub. Date: May 26, 2016

(65) Prior Publication Data

US 2017/0335649 A1 Nov. 23, 2017

Related U.S. Application Data

(60) Provisional application No. 62/081,195, filed on Nov. 18, 2014.

(51) Int. Cl.
*E21B 33/035* (2006.01)
*E21B 7/124* (2006.01)
(Continued)

(52) U.S. Cl.
CPC ..... *E21B 33/035* (2013.01); *E21B 7/043* (2013.01); *E21B 7/046* (2013.01); *E21B 19/09* (2013.01);
(Continued)

(58) Field of Classification Search
CPC ..... E21B 7/043; E21B 7/046; E21B 7/124; E21B 7/185; E21B 19/08; E21B 19/09; E21B 33/035; E21B 33/064; E21B 33/08
See application file for complete search history.

(56) References Cited

U.S. PATENT DOCUMENTS 3,426,844 A * 2/1969 McDaniel ..... E21B 7/128 166/358
3,533,478 A * 10/1970 Tissier ..... E21B 7/124 173/160
(Continued)

FOREIGN PATENT DOCUMENTS

WO 2014186221 A1 11/2014

*Primary Examiner* — Matthew R Buck
(74) *Attorney, Agent, or Firm* — Richard A. Fagin; Adenike Adebiyi

(57) ABSTRACT

A wellbore intervention tool conveyance system includes an upper pipe injector disposed in a pressure tight housing. The upper injector has a seal element engageable with a wellbore intervention tool and disposed below the injector. The upper housing has a coupling at a lower longitudinal end. A lower pipe injector is disposed in a pressure tight housing, the lower housing has well closure elements disposed above the lower pipe injector. The lower housing is configured to be coupled at a lower longitudinal end to a subsea wellhead. The lower housing is configured to be coupled at an upper longitudinal end to at least one of (i) a spacer spool disposed between the upper pipe injector housing and the lower pipe injector housing, and (ii) the lower longitudinal end of the upper pipe injector housing.

21 Claims, 12 Drawing Sheets

(51) Int. Cl.

| | |
|---|---|
| ***E21B 7/04*** | (2006.01) |
| ***E21B 19/09*** | (2006.01) |
| ***E21B 33/064*** | (2006.01) |
| ***E21B 33/08*** | (2006.01) |
| *E21B 29/00* | (2006.01) |
| *E21B 33/06* | (2006.01) |
| *E21B 7/18* | (2006.01) |

(52) U.S. Cl.
CPC ..... *E21B 33/064* (2013.01); *E21B 33/08* (2013.01); *E21B 7/185* (2013.01); *E21B 29/00* (2013.01); *E21B 33/062* (2013.01); *E21B 33/063* (2013.01)

(56) References Cited

U.S. PATENT DOCUMENTS 3,539,024 A * 11/1970 Bleyl ..... E21B 15/04 173/190
3,866,697 A * 2/1975 Rossfelder ..... E21B 7/12 173/193
3,961,673 A * 6/1976 Wolters ..... E21B 7/122 173/32
4,145,014 A * 3/1979 Chatard ..... E21B 19/22 242/390.9
4,595,065 A * 6/1986 Wada ..... E21B 7/027 175/85
4,822,212 A 4/1989 Hall et al.
4,899,823 A 2/1990 Cobb et al.
5,244,046 A * 9/1993 Council ..... E21B 19/22 166/380
6,276,454 B1 * 8/2001 Fontana ..... B65H 75/22 166/343
6,386,290 B1 * 5/2002 Headworth ..... E21B 17/01 166/346
6,431,285 B2 * 8/2002 Hopper ..... E21B 7/043 166/368
7,036,598 B2 * 5/2006 Skjærseth ..... E21B 7/124 166/339
7,431,092 B2 * 10/2008 Haheim ..... E21B 19/22 166/343
7,584,796 B2 * 9/2009 Ayling ..... E21B 7/124 166/358
7,913,764 B2 3/2011 Smith et al.
8,671,626 B1 * 3/2014 Marty ..... E21B 15/04 175/85
8,720,582 B2 * 5/2014 Portman ..... E21B 19/22 166/344
9,564,748 B2 * 2/2017 Strand ..... E21B 43/017
2009/0272520 A1 11/2009 Hug et al.
2012/0193104 A1 * 8/2012 Hoffman ..... E21B 19/002 166/348
2012/0318519 A1 12/2012 Webb
2015/0144357 A1 5/2015 Hampson et al.
2016/0186507 A1 * 6/2016 Varkey ..... E21B 43/128 166/250.01
2017/0241222 A1 * 8/2017 Mangum ..... E21B 23/14

* cited by examiner

SUBSEA SLANTED WELLHEAD SYSTEM AND BOP SYSTEM WITH DUAL INJECTOR HEAD UNITS

BACKGROUND

This disclosure relates to the field of drilling extended reach lateral wellbores in formations below the bottom of a body of water. More specifically, the invention relates to drilling such wellbores where a sub-bottom depth of a target formation is too shallow for conventional directional drilling techniques to orient the wellbore trajectory laterally in the target formation.

Lateral wellbores are drilled through certain subsurface formations for the purpose of exposing a relatively large area of such formations to a well for extracting fluid therefrom, while at the same time reducing the number of wellbores needed to obtain a certain amount of produced fluid from the formation and reducing the surface area needed to drill wellbores to such subsurface formations.

Lateral wellbore drilling apparatus known in the art include, for example and without limitation, conventional drilling using segmented drill pipe supported by a drilling unit or "rig", coiled tubing having a drilling motor at an end thereof and various forms of directional drilling apparatus including rotary steerable directional drilling systems and so called "steerable" drilling motors. In drilling such lateral wellbores, a substantially vertical "pilot" wellbore may be drilled at a selected geodetic position proximate the formation of interest, and any known directional drilling method and/or apparatus may be used to change the trajectory of the wellbore to approximately the geologic structural direction of the formation. When the wellbore trajectory is so adjusted, drilling along the geologic structural direction of the formation may continue either for a selected lateral distance from the pilot wellbore or until the functional limit of the drilling apparatus and/or method is reached. It is known in the art to drill multiple lateral wellbores from a single pilot wellbore to reduce the number of and the cost of the pilot wellbores and to reduce the surface area needed for pilot wellbores so as to reduce environmental impact of wellbore drilling on the surface.

Some formations requiring lateral wellbores are at relatively shallow depth below the ground surface or the bottom of a body of water. In such cases using conventional directional drilling techniques may be inadequate to drill a lateral wellbore because of the relatively limited depth range through which the wellbore trajectory may be turned from vertical to the dip (horizontal or nearly so) of the formation of interest.

DETAILED DESCRIPTION

Example methods and apparatus described herein are related to drilling wells below the bottom of a body of water such as a lake or the ocean, using a water-bottom located template onto which a wellhead and injector assembly is mounted at an angle inclined from vertical. An inclined wellhead and injector assembly enables reaching a horizontal (lateral) trajectory at relatively shallow sub-bottom depths, for example, for exploiting hydrocarbon reservoirs that are located very shallow below the seafloor. There are a number of geographic locations worldwide where such drilling technique is relevant, where ordinary vertical entry drilling methods are inadequate to drill a horizontal wellbore due to the need for longer distance to reorient the wellbore from vertical to horizontal. In addition, the deployment of wellbore devices, for example, electrical submersible pumps that have a substantial length and outer diameter to achieve required fluid lift rates can be impractical if a wellbore build angle is too steep. invention system and method as described herein alleviates that problem by substantially reducing the wellbore deviation build rate (or "dog leg severity").

Also described herein is a dual injector head system, where the lower injector is primarily for inserting a drill string into the wellbore, while the upper injector is primarily for retrieving a drill string from the wellbore. The drill string can be based on jointed drill pipe, a spoolable rod, a spoolable tube (like for example coiled tubing) or similar.

Figure 1:
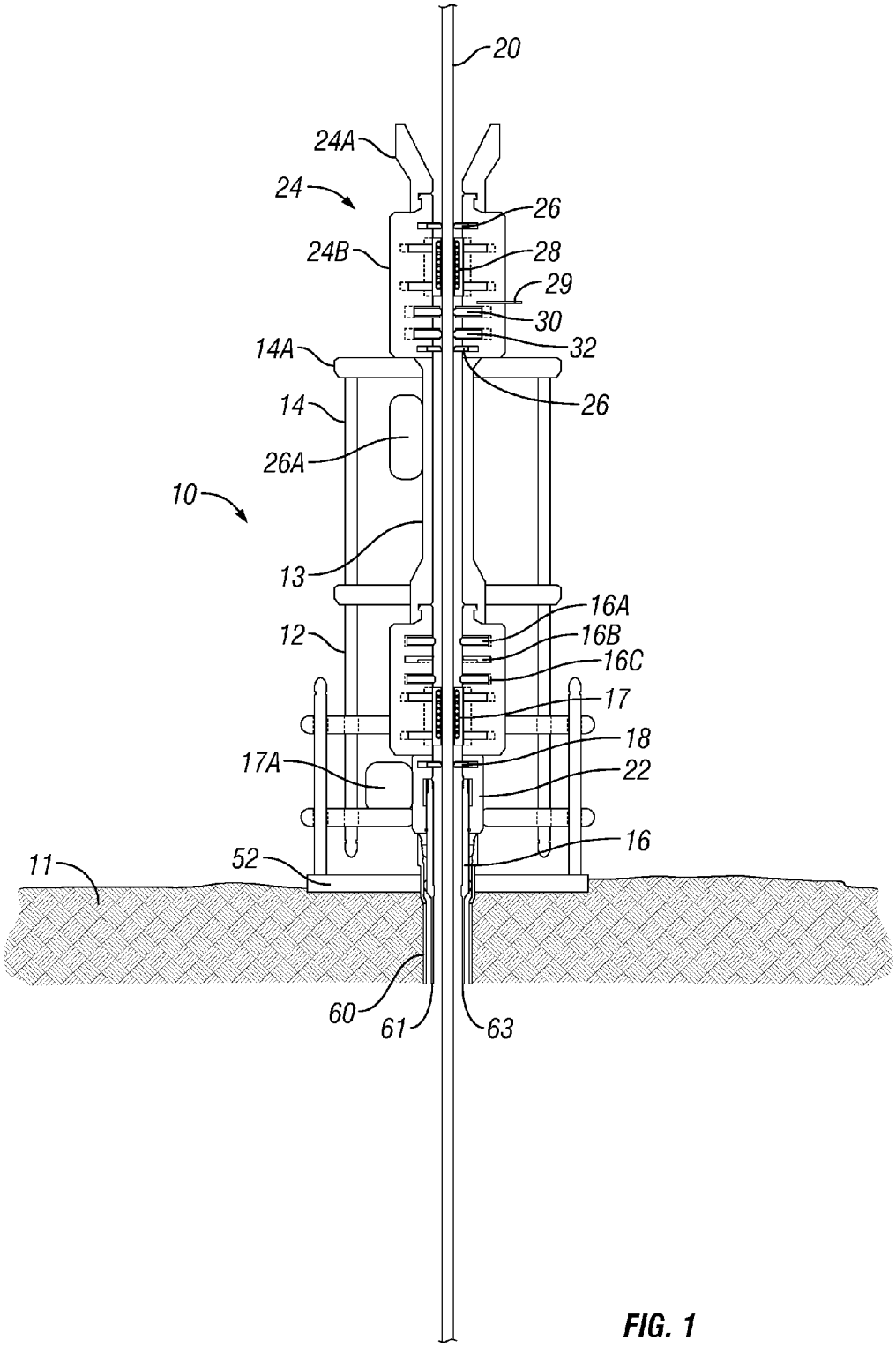
FIG. 1 shows a subsea injector for a drilling system based on a spoolable tube, umbilical, rod or jointed drill pipe, landed on wellhead e.g. with standard H4 type wellhead connector.

FIG. 1 shows a subsea wellhead and pipe injector system 10 (hereinafter "system") mounted to a template 52 disposed on the bottom 11 of a body of water. The system 10 may be used for any form of well intervention, including without limitation, drilling, running casing or liner and workover of completed wells. Such intervention may be performed using a spoolable tube such as coiled tubing, an umbilical cable or semi-stiff spoolable rod, or jointed (threadedly connected) pipe. The system 10 may comprise an upper injector assembly 14 landed on a spacer spool 13 and supported by a frame 14A that transmits the weight of the upper injector assembly 14 to the template 52. Connections between a surface casing 61 in a wellbore 63 may be made, e.g., with industry standard H4 type wellhead connectors. A lower injector and blowout preventer assembly 12 may be coupled to the wellhead 16 at one longitudinal end and at the other longitudinal end to one longitudinal end of the spacer spool 13. The spacer spool 13 may be coupled at its other longitudinal end to the upper injector assembly 14.

The upper injector assembly 14 may comprise a housing 24 having a suitably shaped entry guide 24A to facilitate entry of a well intervention assembly 20 into the wellbore. The housing 24 may comprise internally an upper pipe injector 28 of types well known in the art. A wiper 26 may be disposed above the upper pipe injector 28 so that any contamination on the exterior of the well intervention assembly 20 is removed before the well intervention assembly leaves the upper injector assembly 14 and is exposed to the surrounding water. Upper 30 and lower 32 stuffing box seals may be provided below the upper pipe injector 28 so that wellbore fluids cannot escape as the well intervention assembly is moved into and out of the wellbore 63. A lower wiper 26 may be disposed below the lower stuffing box seal 32 to prevent contaminants from entering the wellbore 63 as the wellbore intervention assembly 20 is moved into the wellbore 63.

The lower injector assembly 12 may also be supported by the frame 14A. The lower injector assembly 12 may include a lower pipe injector 17, a lower wiper 18 below the lower pipe injector 17 and blowout preventer elements, e.g., pipe rams 16A, shear rams 16B and blind rams 16C as may be found in conventional blowout preventers (BOPs). Operation of the lower pipe injector 17 and the respective rams 16A, 16B, 16C may be performed by a control module 17A. The control module 17A may comprise any form of BOP operating telemetry system known in the art, or may be connected to a vessel on the surface (FIG. 12) using an umbilical cable (not shown in FIG. 1). Operation of the stuffing boxes 30, 32 and the upper pipe injector 28 may be performed by a corresponding control module 26A.

The upper 28 and lower 17 pipe injectors may be activated individually or simultaneously to push or pull, as the case may be, an umbilical cable, semi-stiff spoolable rod, coiled tubing or jointed pipe. Two simultaneously operated pipe injectors 28, 17 may be integrated for deployment into, and retrieval of a well intervention tool assembly from the wellbore 63.

The pipe injectors 28, 17 in the present embodiment may be integrated into a lubricator and BOP system, in contrast with coiled tubing injector apparatus known in the art where there would be one only pipe injector located externally of the lubricator. Having the injector located "externally" in the present context means that the intervention umbilical, rod, coiled tubing and the like must be pushed through seals that are normally exposed to a much higher pressure within the wellbore than the ambient pressure outside the wellbore. The differential pressure may result in more wear on seals and the intervention umbilical, rod or coiled tubing. More clamping force may also be required by the injector not to slip on the intervention umbilical, rod or coiled tubing. Thus, placement of the injectors inside the wellbore pressure containment system may reduce clamping forces required by the injectors and may reduce wear on the tubing and seals.

The principle of operation of the system 10 is based on placing the upper pipe injector 28 that is used for pulling the wellbore intervention tool assembly out of the wellbore 63 at a location above the wellbore pressure seals, i.e., the stuffing box seals 30, 32 and the BOP rams 16A, 16B, 16C. The lower pipe injector 17 may be used to urge the wellbore intervention tool assembly into the well and may be located below the above described wellbore pressure seals, where the lower pipe injector 17 pulls the umbilical, rod or coiled tubing through the wellbore pressure seals and pushes the umbilical, rod or tubing into the wellbore with no friction increasing seals located below the lower pipe injector 17. Both the upper 28 and lower 17 pipe injectors can be used simultaneously for increased efficiency and speed, if required.

Although the above description is made in terms of a drilling method based on a spoolable umbilical, rod or coiled tubing, it should be understood that also jointed pipes or tubing may be utilized in other embodiments.

Figure 2:
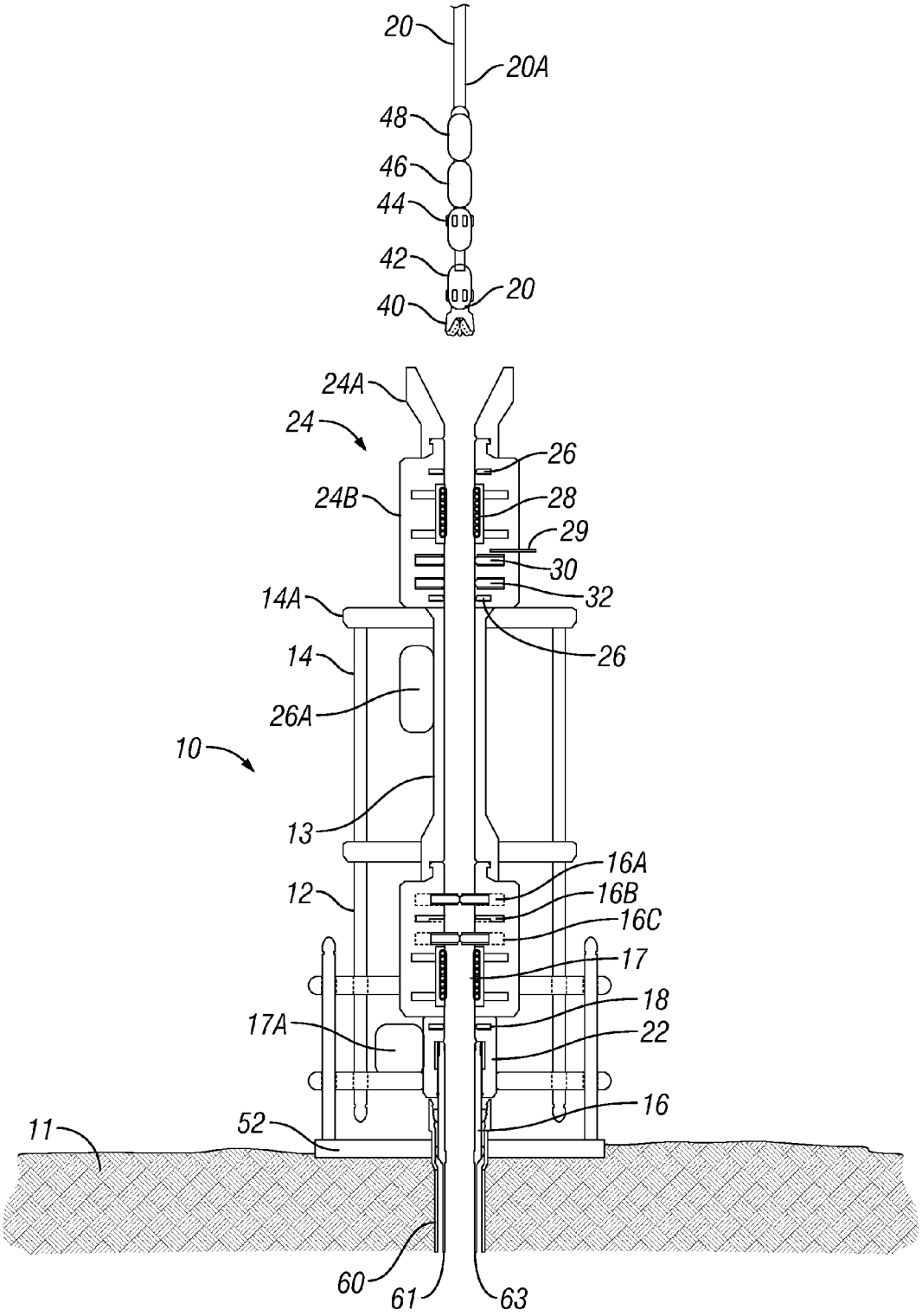
FIG. 2 shows deployment or retrieval of a wellbore intervention tool assembly from a live (pressurized) wellbore situation, where blowout preventer (BOP) seal rams are closed.

FIG. 2 shows deployment or retrieval of a wellbore intervention tool assembly 20 from a live (pressurized) wellbore, where blowout preventer (BOP) seal rams 16A, 16C are closed while the wellbore intervention tool assembly 20 is removed from the system 10 or is inserted into the system 10. In the present example embodiment, the wellbore intervention tool assembly comprises a drilling tool assembly coupled to a coiled tubing 20A. The drilling tool assembly may comprise a drill bit 42, a drilling motor 40 such as an hydraulic motor to rotate the drill bit 40, and anchor 44 to transfer reactive torque from the drilling motor 42 to the wellbore wall or internal pipe and measuring instruments 46, 48 such as logging while drilling (LWD) and measurement while drilling (MWD) instruments. Other forms of wellbore intervention tool assembly may be used in different embodiments.

Figure 3:
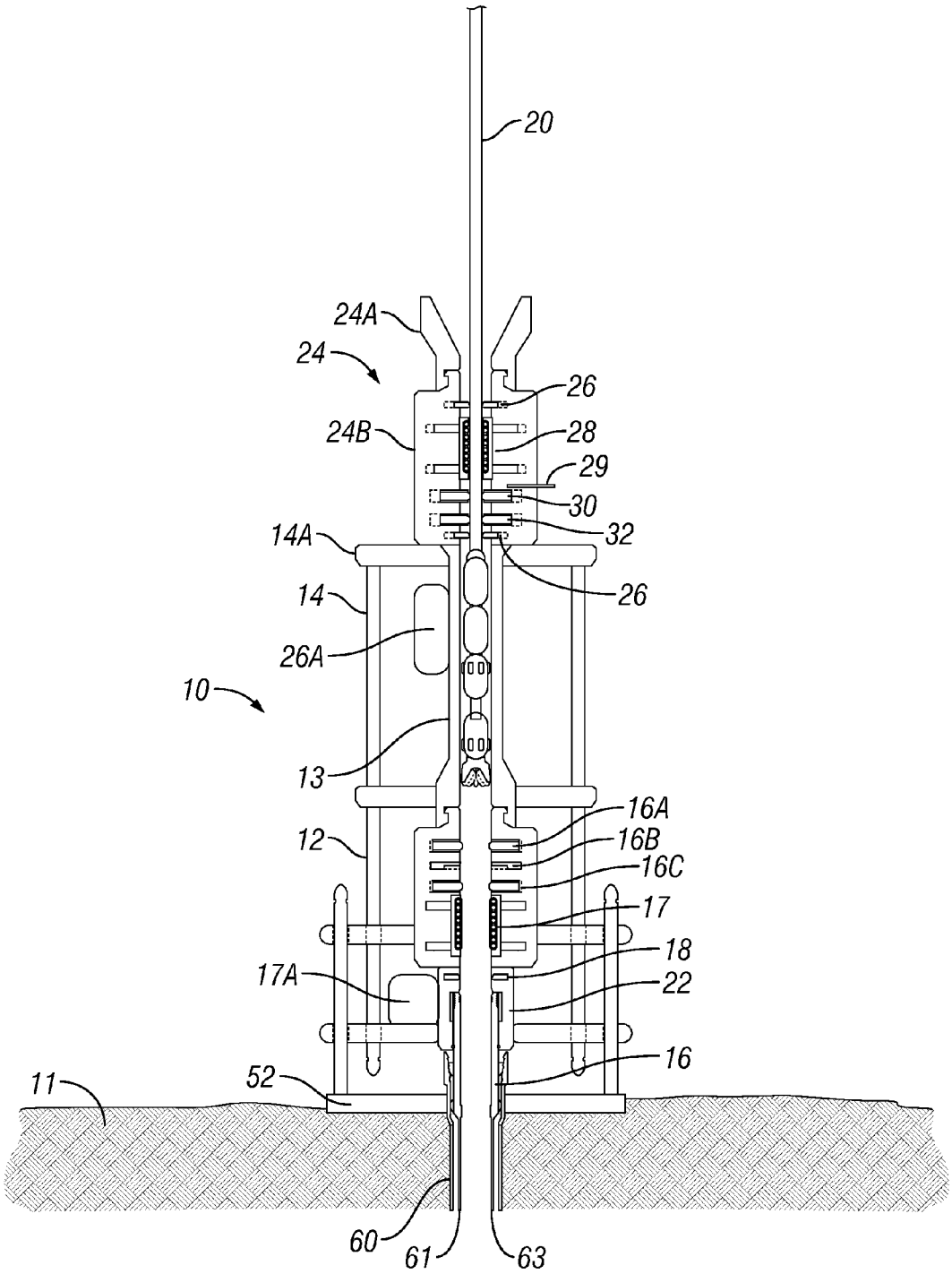
FIG. 3 shows deployment or retrieval of a wellbore intervention tool assembly in a live wellbore situation, where upper seals are closed around an umbilical, coiled tubing or spoolable rod while the upper injector is pushing or pulling on the umbilical. When the wellbore intervention tool assembly is below the BOP, the lower injector is also utilized.

FIG. 3 shows deployment or retrieval of the wellbore intervention tool assembly 20 in a live wellbore, where the stuffing box seals 30, 32 are closed around the wellbore intervention tool assembly 20 while the upper pipe injector 28 is pushing or pulling on the wellbore intervention tool assembly 20. When the wellbore intervention tool assembly 20 extends below the BOP 16A, 16B, 16C, the lower injector 17 is also used to move the wellbore intervention tool assembly 20.

Figure 4:
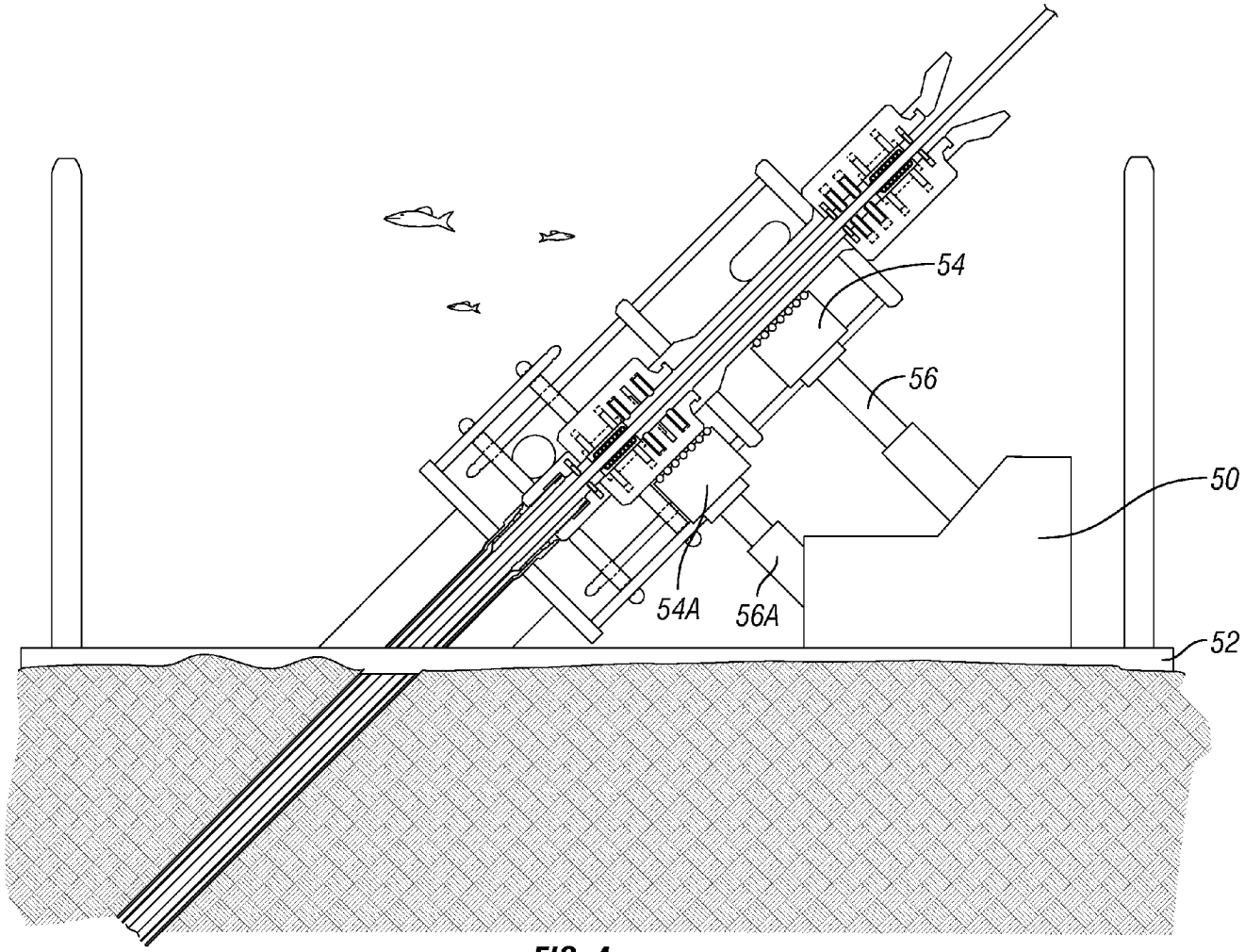
FIG. 4 shows an example slant-entry wellhead system.

FIG. 4 shows an example slant-entry wellhead system. One aspect of the slant-entry wellhead system is a movable support 50 having hydraulic cylinders 56, 56A affixed thereto. The movable support 50 is mounted to the subsea template 52. Having a movable support 50 for modules landed onto the template 52 facilitates setting a conductor pipe and assembling the injector and wellhead assembly to the wellhead (16 in FIG. 1). Although the following description is made in terms of using an upper injector assembly and a lower injector assembly as explained with reference to FIG. 1, it should be understood that the scope of the present disclosure in constructing a slant-entry wellbore is not limited to the use of the two above-described injector assemblies.

Wellheads of types known in the art can be utilized, but will be installed on the subsea template at an angle as illustrated in FIG. 4. Such angle may be at least ten degrees inclined from vertical, and will depend on the depth below the water bottom at which the wellbore is required to be drilled substantially horizontal. A pilot wellbore and necessary conductor pipe will need to be drilled or jetted through the template 52, where a guide funnel system may be used to facilitate installing the conductor pipe. Such a guide funnel can be retrieved prior to installing the wellhead. Jacks with guides 54, 54A can also be used to assist the operation. These jacks, shown as hydraulic cylinders 56 and 56A may function like robotic arms, that can also perform other operations as securing the entry angle of conductor pipe, casing, and the like, in addition to being able to adapt to various handling tools, inspection tools, visualization tools, etc. The jacks 56, 56A may each be rotatable such that its longitudinal axis may be oriented at any selected angle with respect to vertical. The system illustrated in FIG. 4 may comprise all the components described above with reference to FIGS. 1 through 3, with the inclusion of the movable support 50 and it associated components.

Figure 5:
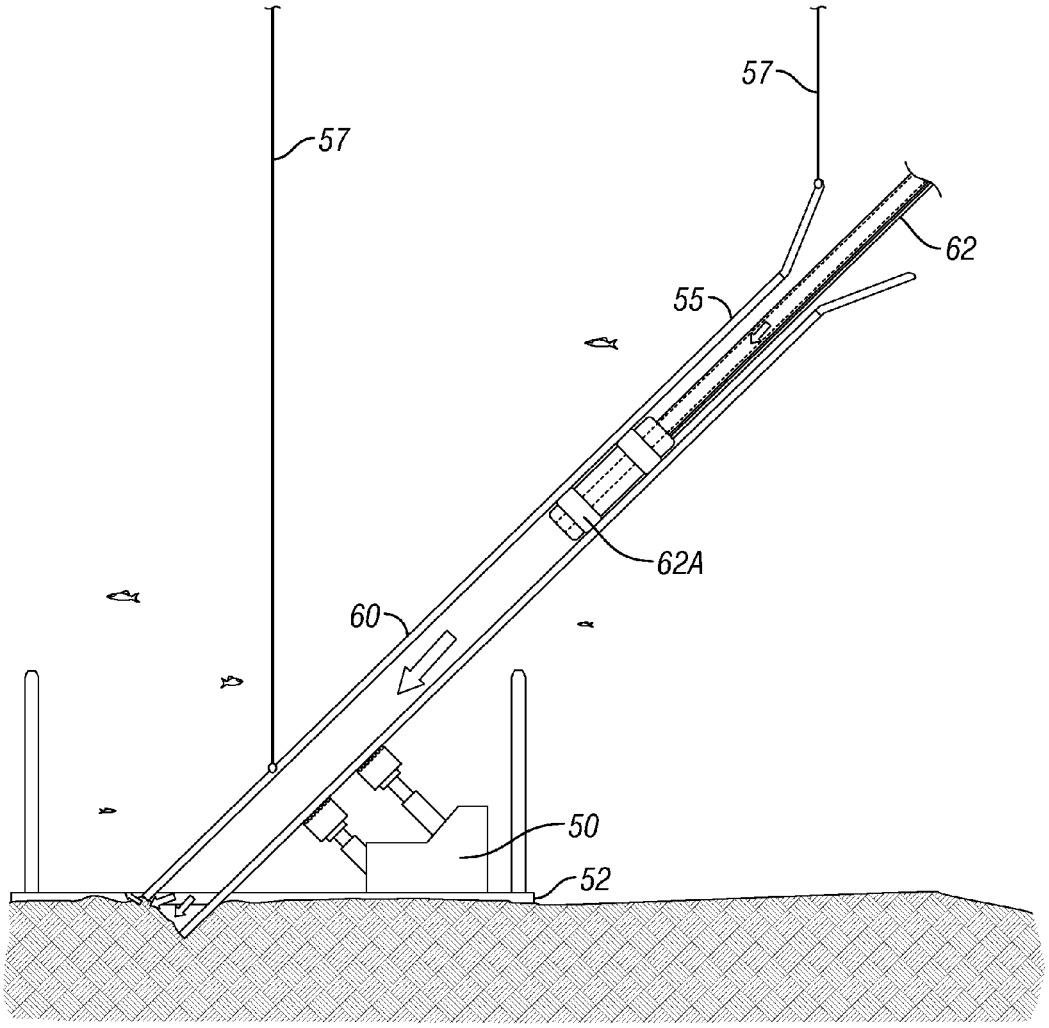
FIG. 5 shows how a conductor pipe can be installed subsurface, where the conductor is jetted down using water.

FIG. 5 shows how a conductor pipe 60 can be installed subsurface, where the conductor pipe 60 is jetted down using water. A deployment tool 62 with one or more packing elements 62A may be used to lower the conductor into the sea, as well as being coupled to a hose from the water surface (whereon a vessel having a pump is disposed) being able to jet the conductor into the sub-bottom using high pressure water supplied from the surface or from a pump system placed on the seafloor. FIG. 5 shows water being pumped into the conductor pipe 60, where the conductor pipe 60 is then jetted into the sub-bottom. Also shown are two lifting wires 57 for deploying and supporting the conductor pipe 60 during jetting. The two hydraulic cylinders 56, 56A shown may be used to support the conductor pipe 60 at the required angle when driving the conductor pipe 60 into the sub-bottom. A larger and longer temporary support (e.g. a longitudinal cut large bore tube ("tray")) can be mounted to both hydraulic cylinders 56, 56A, where the angle of the support would be set to the required conductor pipe 60 entry angle. In the present embodiment, a guide funnel 55 may be coupled to the upper end of the conductor pipe 60 to facilitate entry of various tools therein for jetting and/or drilling the sub-bottom to place the conductor pipe 60 at a required depth.

For those skilled in the art of offshore drilling, it will be appreciated that an alternative to jetting the conductor pipe 60 as illustrated, is that the conductor pipe 60 can be drilled into the seabed with a motor placed on top of the conductor or coupled to the exterior of the conductor. Also a jet drilling system can be deployed into the lower end of the conductor pipe 60, where such jet drilling system is retrieved after conductor has been placed to the required depth.

Another method for setting the conductor pipe 60 is to hammer the conductor pipe 60 into the sub-bottom, which is common for vertical conductor installations. For both the latter methods, the support system 50 may hold the conductor pipe 60 at the required angle during the hammering procedure.

Figures 6, 6A:
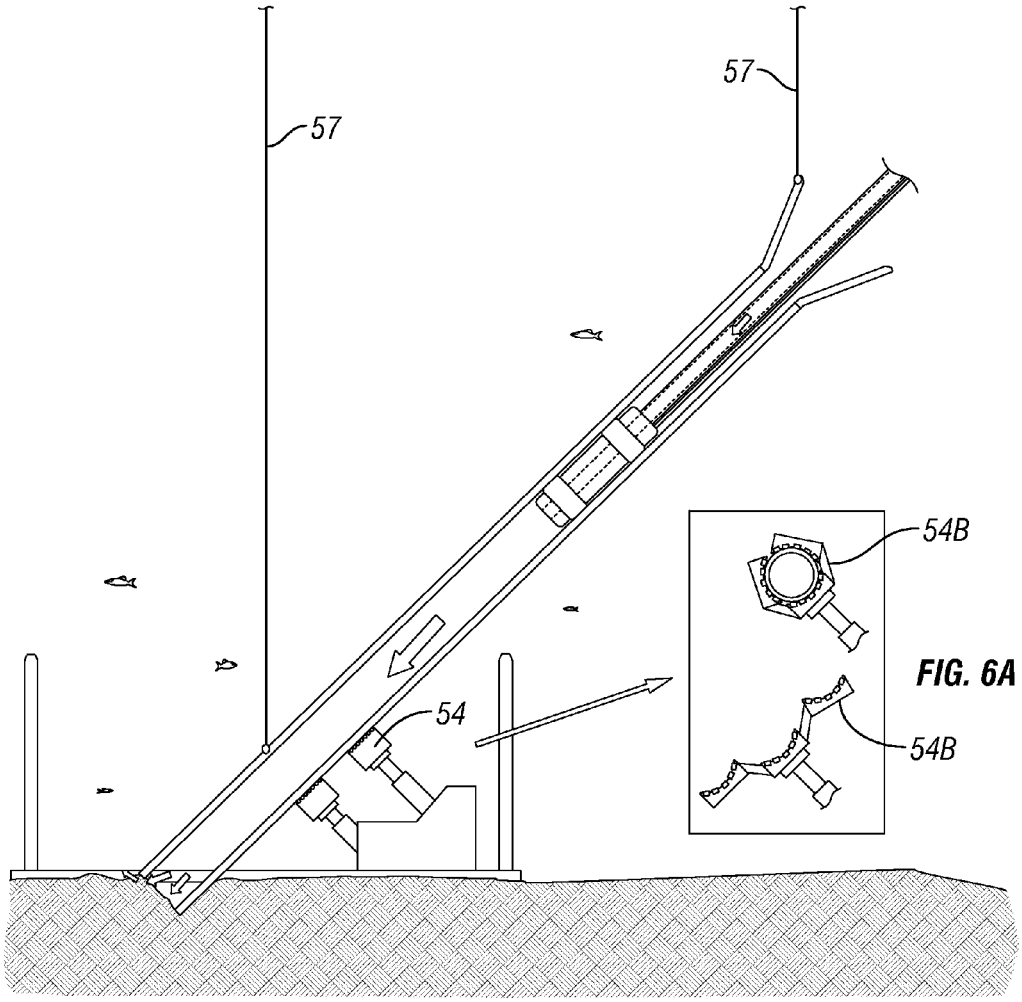
FIG. 6 shows the conductor jetted to a required depth.
FIG. 6A shows attachments at the end of hydraulic cylinders on a support.

1. FIG. 6 shows the conductor pipe 60 disposed to a required depth. Now, the wellbore can be drilled deeper with any known drilling system, followed by the installation and cementing of a first (surface) casing string. In some embodiments a drillable material or a material that will gradually dissolve by time by being exposed to certain fluids, for example sea water, may be coupled to the lower end of the conductor pipe 60. Any remaining material may be removed using the wellbore intervention tool assembly (20 in FIG. 1) when such wellbore intervention tool assembly is a drilling system powered by fluid pumped from the surface or from a subsurface located pumping system, or if so equipped by an electric or hydraulic motor if such is used as the motor (42 in FIG. 1)

The wellhead will be mounted on the upper end of the surface casing. The wellhead may be landed onto the conductor pipe, whereafter the BOP can be connected to the wellhead when required. FIG. 6A shows one or both the hydraulic jacks can be equipped with various handling tools 54A, as for example a gripper as illustrated. Such a gripper 54A can take hold of, support the weight of and guide equipment landed on the support system 50 or into the wellbore. A gripper may also contain a motor system for rotation of e.g. conductor pipe, casing strings and the like, as well as a function to drive a module (conductor, casing, valve system, etc.) up and down. A solution may be envisaged where one of the hydraulic cylinders 56 spins a large bore tube, while the other hydraulic cylinder 56A pushes same tube into the wellbore.

Figure 7:
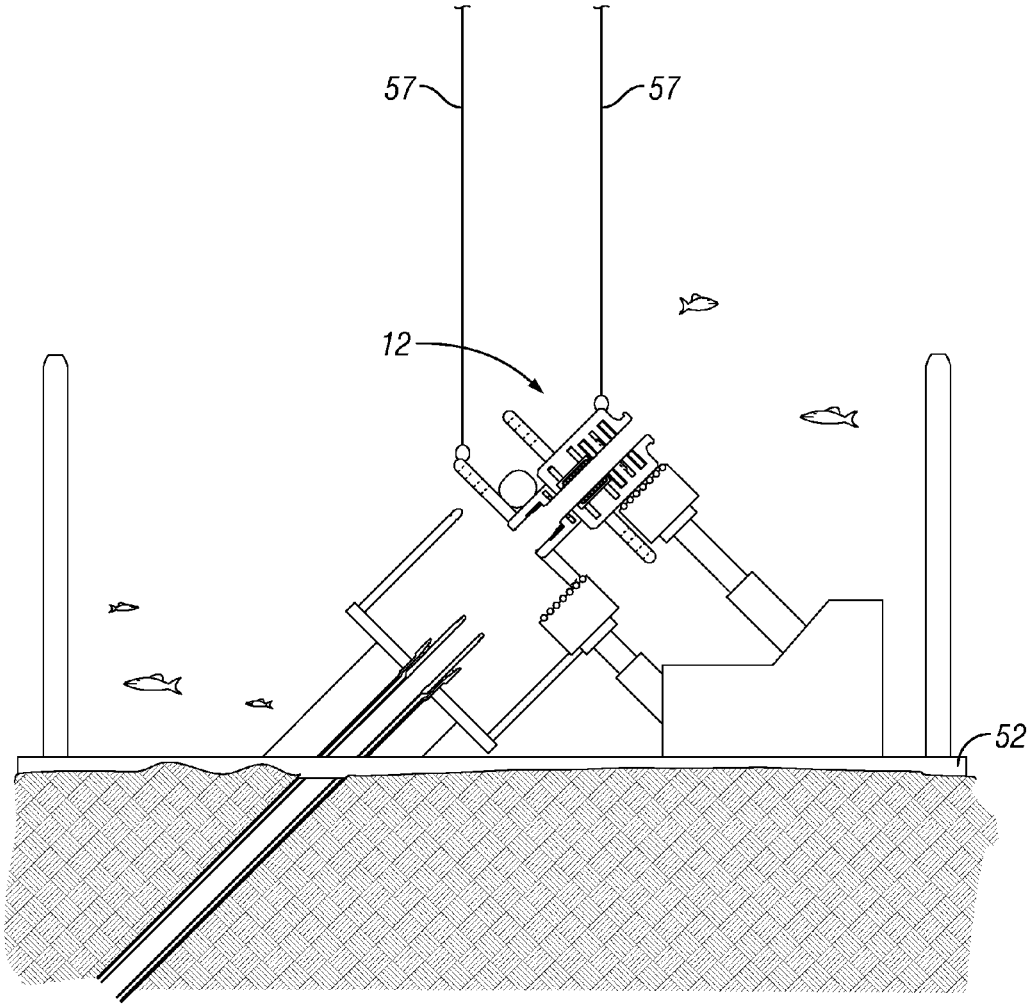
FIG. 7 shows a subsea wellhead (landed into the conductor) and template, where a BOP system is lowered by cables or the like from a surface vessel.
Figure 12:
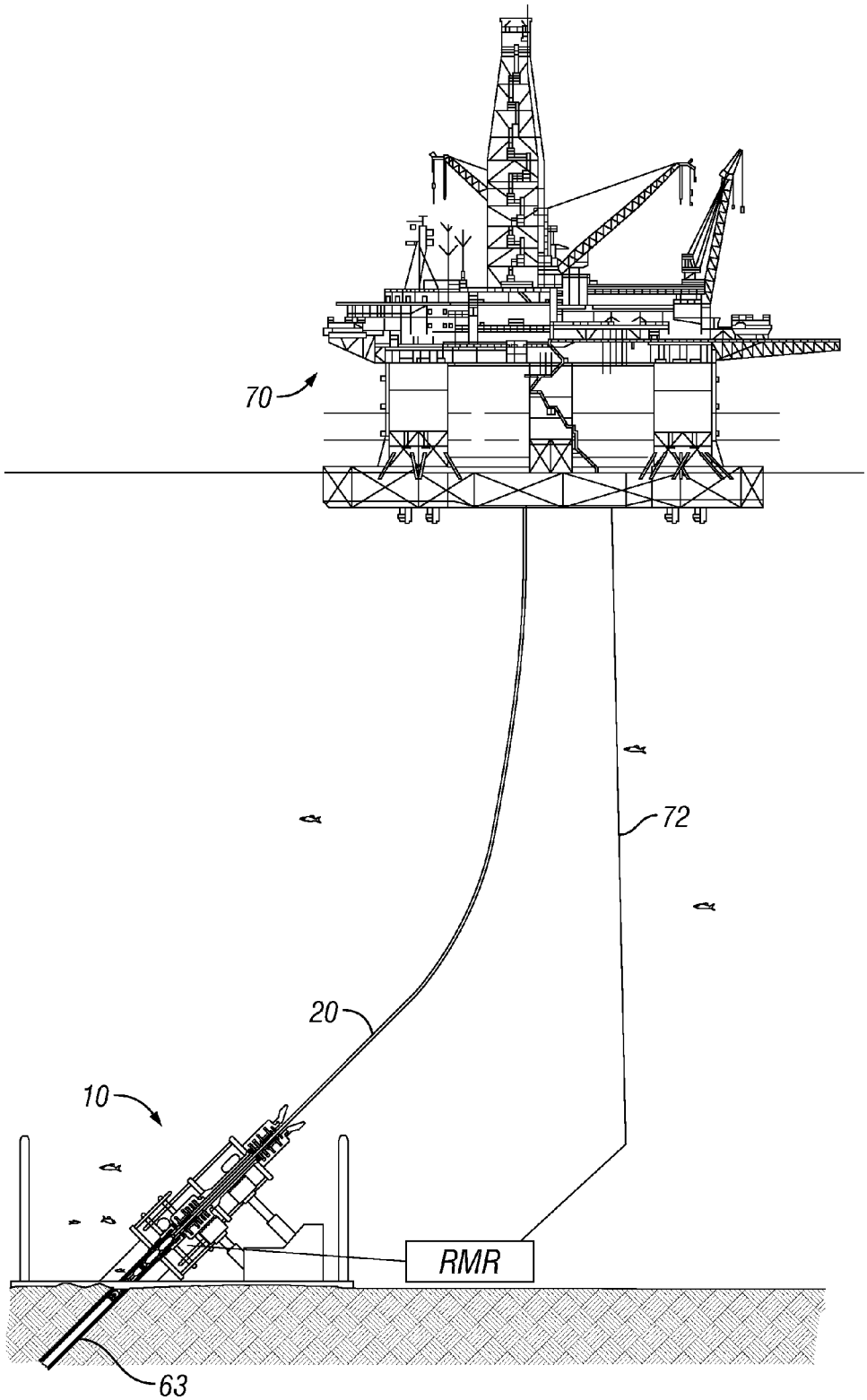
FIG. 12 shows a pipe such as a spoolable rod, coiled tubing or jointed pipe deployed into the wellbore, where injectors, seals and wipers have been activated.

FIG. 7 shows the lower injector assembly 12 being lowered onto the conductor pipe 60 and the template 52, where the wellhead 12 is lowered by cables 57 or the like from a surface vessel (FIG. 12). The hydraulic cylinders 56, 56A, for example, may be used for guiding and supporting the lower injector assembly 12 onto the template 52.

Figure 8:
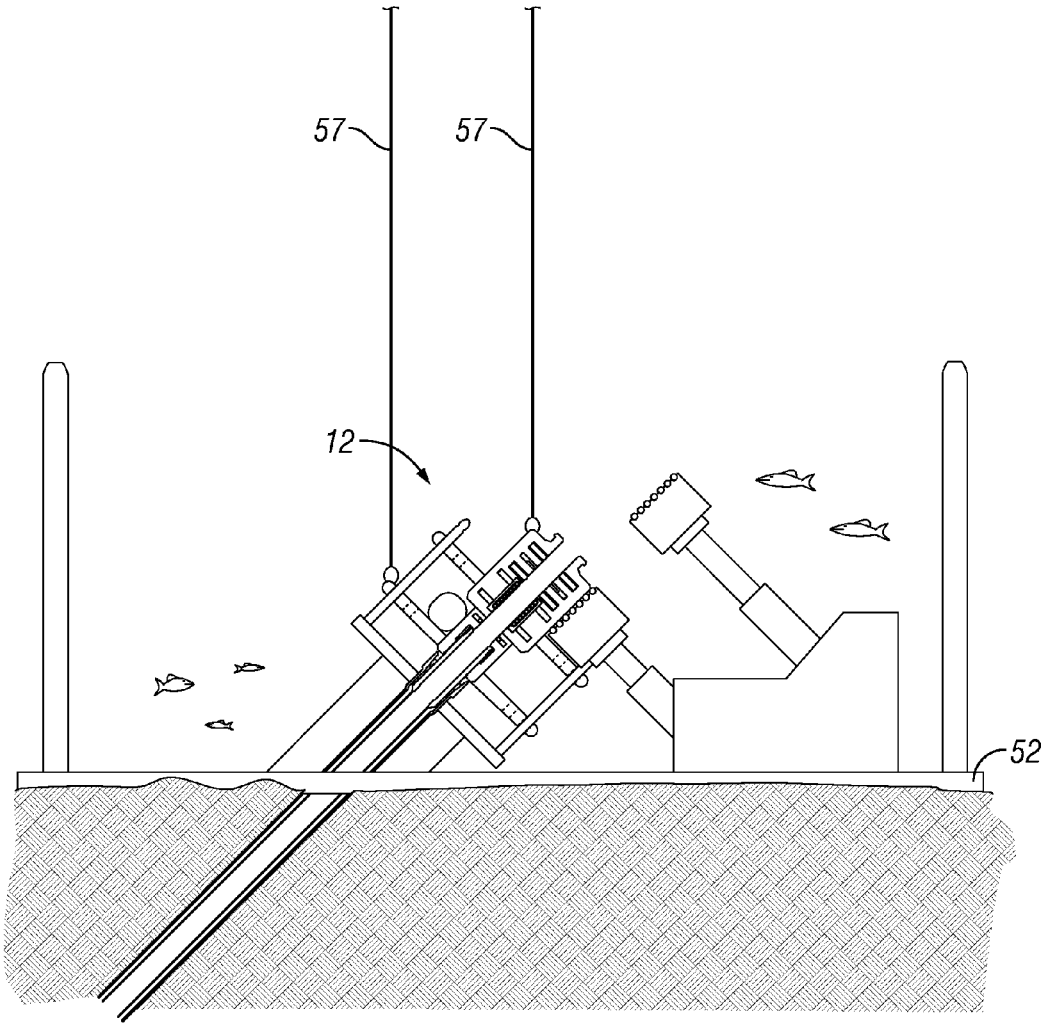
FIG. 8 shows the subsea BOP being stabilized and guided by an hydraulic guide support system.

FIG. 7 also shows the lower injector assembly 12 being stabilized and guided by the support 50 and the hydraulic cylinders 56, 56A using supports 54, 54A at the end of each hydraulic cylinder 56, 56A FIG. 8 shows the lower injector assembly 12 landed and latched onto the wellhead 16.

Figure 9:
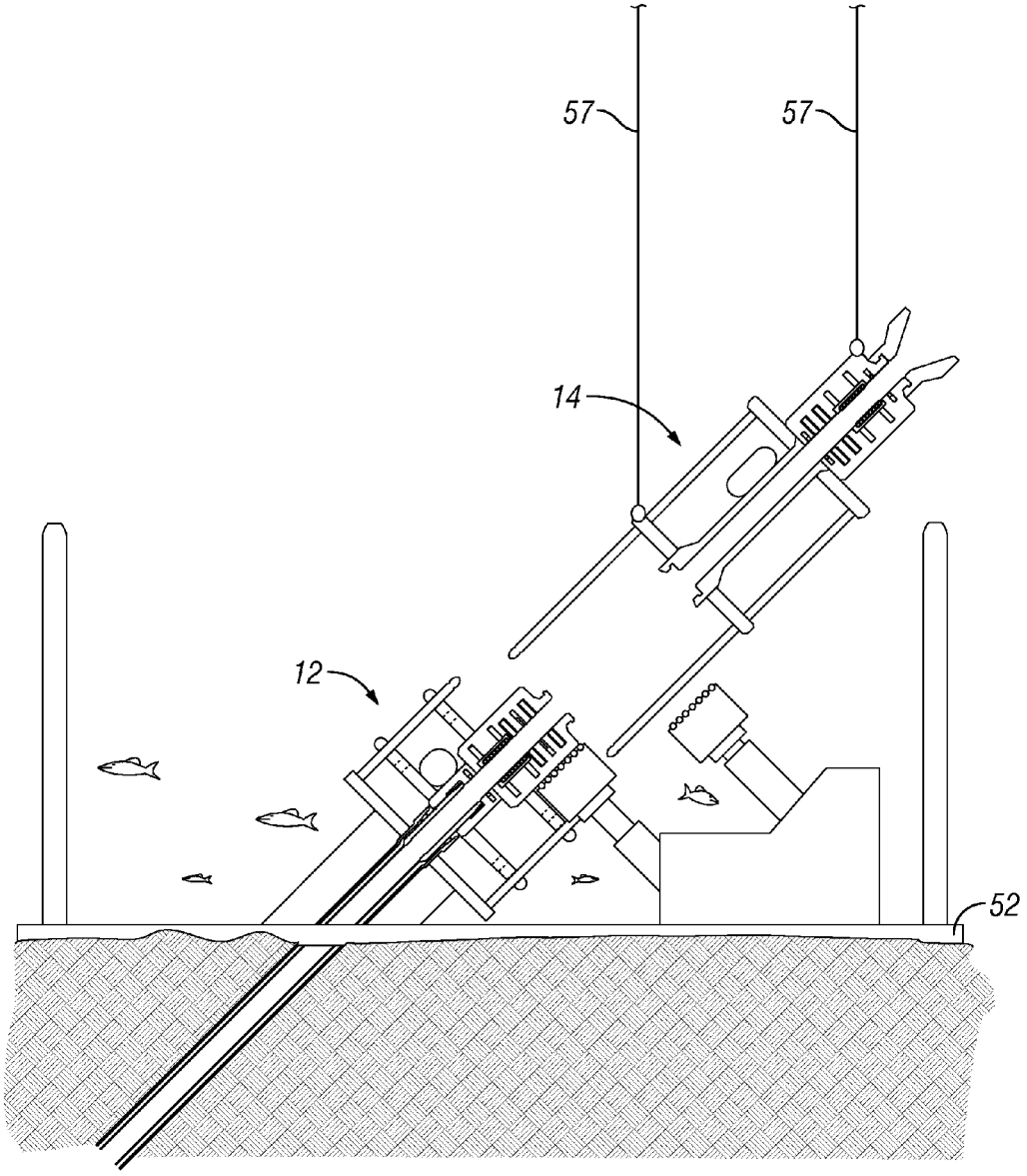
FIG. 9 shows the subsea BOP assembly landed and latched onto the wellhead.
Figure 10:
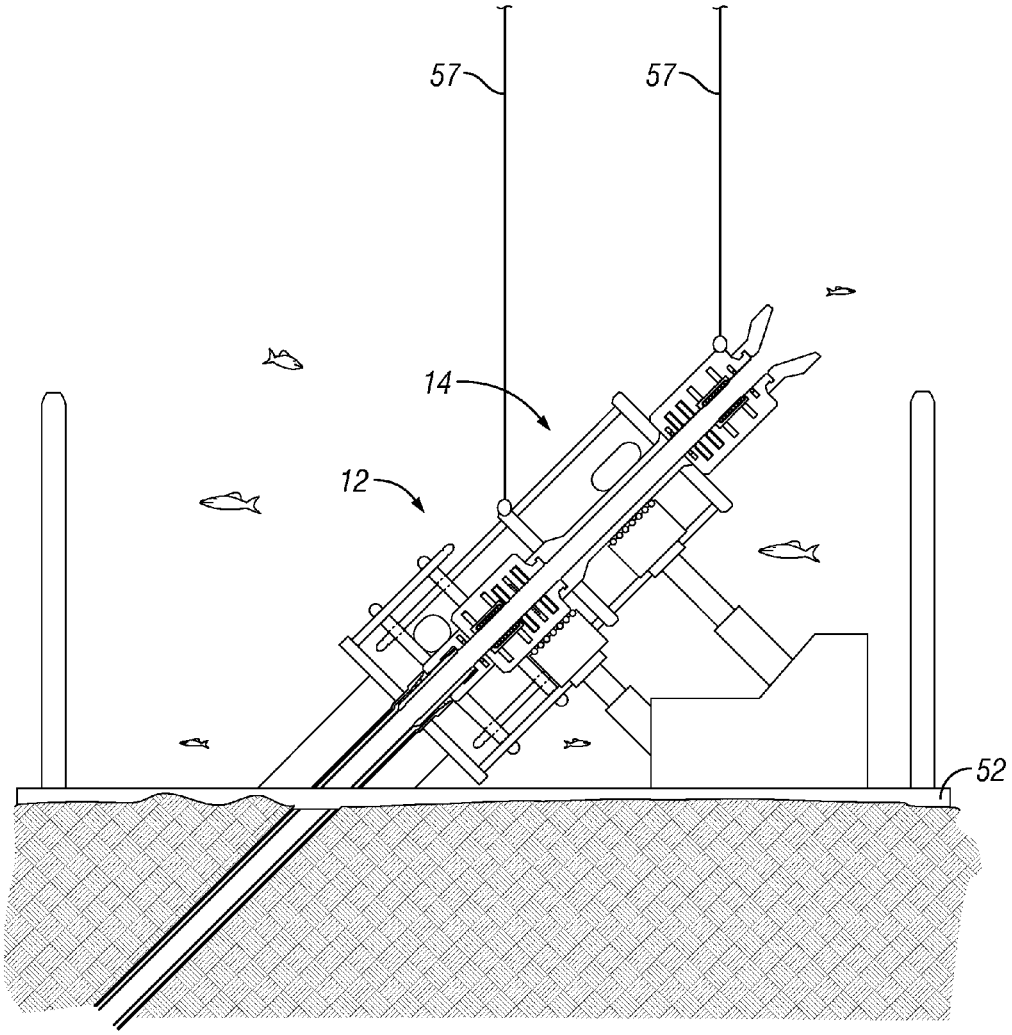
FIG. 10 shows the upper injector and sealing system guided onto the wellhead and BOP by the hydraulic guide support system.

FIG. 9 shows the upper injector assembly 14 being lowered by cables 57 from the vessel (FIG. 12) for coupling to the lower injector assembly. FIG. 10 shows the upper injector assembly being guided onto the wellhead and the lower injector assembly 12 by the hydraulic cylinders 56, 56A and the support 50 on the template 52.

Figure 11:
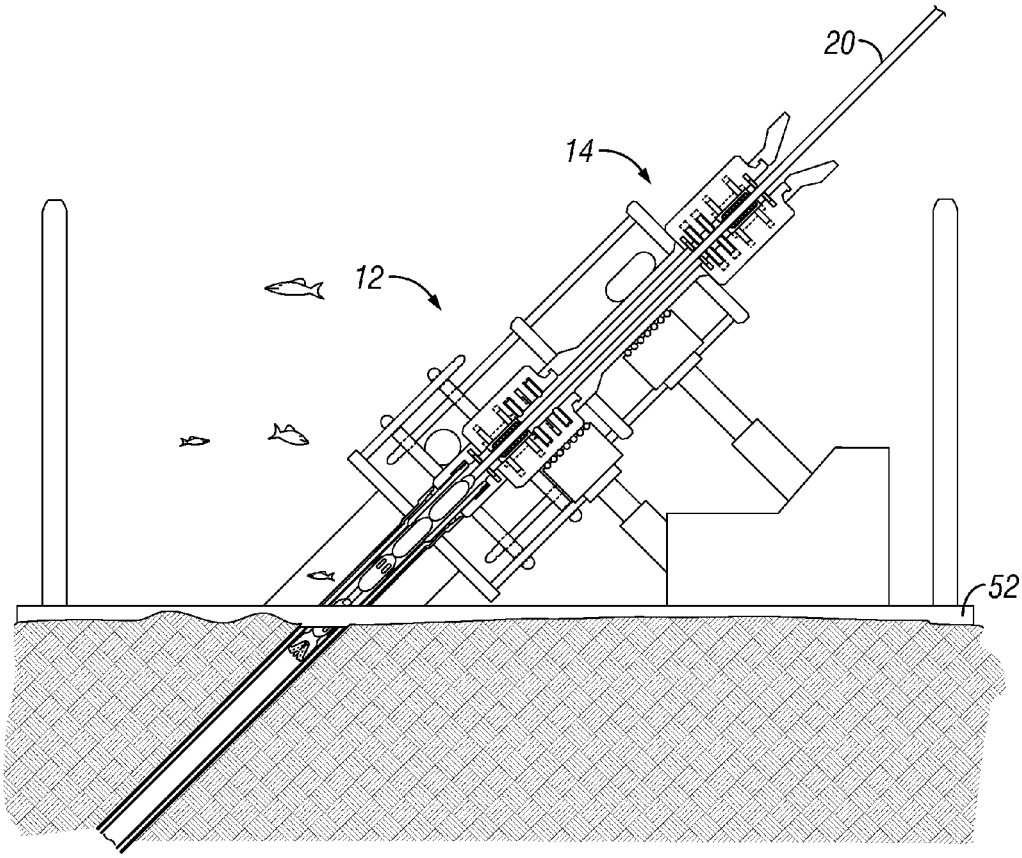
FIG. 11 shows the upper injector and sealing system guided and latched onto the wellhead and BOP, assisted by the hydraulic guide support system.

FIG. 11 shows a pipe such as a spoolable rod, coiled tubing or jointed pipe deployed into the wellbore, where injectors, seals and wipers have been activated for wellbore intervention purposes.

FIG. 12 shows a vessel 70 on the water surface from which may be deployed all of the above described apparatus. In FIG. 12, the wellbore intervention tool system 20 is extended from the vessel through the system 10 and into the wellbore 63 below. Fluid may be supplied from pumps (not shown) on the vessel 70 through the wellbore intervention tool system 20 for any intervention purpose known in the art. In some embodiments, the need for a riser or similar conduit extending from the system 10 to the vessel 70 may be eliminated by using a riserless mud return system RMR such as may be obtained from Enhanced Drilling, A. S., Karenslyst allé 4, P.O Box 444, Skøyen, 0213 Oslo, Norway and as more fully described in U.S. Pat. No. 7,913,764 issued to Smith et al.

Using a system as shown in FIG. 1, either with or without the RMR system shown in FIG. 12, in some embodiments, it is possible to replace wellbore fluid inside the space between the upper pipe injector housing to any selected depth in the wellbore. Such fluid replacement may be performed by inserting the wellbore intervention tool assembly 20 into the wellbore (63 in FIG. 1) to any selected depth while the seals 30, 32 are closed so as to sealingly engage the wellbore intervention tool assembly 20. Fluid, such as seawater may be pumped into the wellbore intervention tool assembly 20 from the surface (e.g., from the vessel 70). As fluid is pumped into the wellbore 63 through the wellbore intervention tool assembly 20, existing fluid in the wellbore 63 may be displaced and discharged through a fluid outlet (29 in FIG. 1). The fluid outlet may be connected to a fluid line 72 that returns the discharged fluid to the vessel 70 or to any other storage container.

Possible benefits of a system and method according to the present disclosure may include any one or more of the following:

a) placing a wellhead at an angle under water to enable drilling horizontal wells in shallow sub-bottom formations;

b) placing a BOP and/or lubricator and seal stack system at an angle deviating from vertical on a subsea template;

c) jetting in a conductor pipe at an angle. Alternatively, drilling the conductor in by a motor connector to the conductor;

d) placing a lubricator and a seal stack system deviating from vertical on a subsea wellhead;

e) using an injector built into a pressure containing housing, where injector will be exposed to wellbore fluids and pressure;

f) using an injector located on the elevated pressure side of a sealing system preventing wellbore fluids from escaping to the outside environment;

g) combining two injectors, where one is primarily for inserting a drill string into the wellbore, while the other is primarily for retrieving a drill string from a wellbore.

h) combining two injectors, where both can be simultaneously operated at same speed to insert or retrieve a drill string from a wellbore;

i) combining two injectors, where each of these can be adjusted according to the outer diameter (OD) of an object passing through the injectors, so that a tool system can be inserted or retrieved from the lubricator while pushing in or pulling out by the injectors. An example can be that a bottom hole tool assembly is pushed in by the upper injector against the drilling umbilical, coil or drill pile with the lower injector not engaging the bottom hole tool assembly. Thereafter, as soon as the bottom hole assembly has passed through the lower injector, the lower injector is engaged towards the drill string (coil, umbilical or drill pipe) driving this string into the wellbore, while the upper injector are no longer responsible for pushing the string into the wellbore;

j) using a wiper seal to remove wellbore clay and the like from the drill string, before the drill string protrudes through the main seals in a BOP system.

k) using a wiper seal to remove wellbore clay and the like from the drill string, before the drill string protrude through the main seals in a lubricator stuffing box system;

l) providing capability to change out wellbore fluids with clean sea water in a lubricator prior to opening an upper stuffing box to insert or retrieve wellbore intervention tools or tool strings. This can be achieved by pumping in seawater and taking discharge to the surface for cleaning;

m) using an adjustable support system to guide and support weight of components engaging onto and landing into a seabed template;

n) using a sea bed lubricator system with a sealing system on a top end thereof, where a well intervention tool assembly on a pipe or pipe string can be inserted or retrieved in a safe manner without the need for a riser to surface. The foregoing is performed by individually closing and opening the upper or lower sealing system as well as displacing wellbore fluids with clean seawater prior to retrieval of the wellbore intervention tool assembly through the upper seal system;

o) mounting a drillable (for example manufactured in a material easy to drill out after use, or a material that will gradually dissolve by time by being exposed to certain fluids, like for example sea water) drilling system on the lower end of a conductor, where the drilling system is powered by fluid pumped from the surface or from a subsurface located pumping system;

p) deploying a drill string from a surface semisubmersible drilling rig or vessel, where the drill string enters a sea bed wellbore at an angle higher than 10 degrees from vertical;

q) increasing axial force ("weight on bit") on a subsurface drill string, by using one or two injectors integrated in a sea bed located BOP and/or lubricator system.

r) replaceable modules that can be mounted on hydraulic jacks, where such modules can perform tasks as lifting, guiding, rotating, etc.

s) increasing length of external sealing, by e.g. cement, of casing strings by placing wellbore at an angle instead of vertical, which is critical with respect to very shallow reservoirs t) introducing a submerged "goose neck" system to support and guide a drill string deployed from a surface vessel or drilling rig While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A wellbore intervention tool conveyance system, comprising:

an upper pipe injector disposed in a pressure tight housing, the upper pipe injector housing having at least one seal element engageable with a wellbore intervention tool assembly and disposed below the upper pipe injector, the upper pipe injector housing having a coupling at a lower longitudinal end thereof, a lower pipe injector disposed in a pressure tight housing, the lower pipe injector housing having well closure elements disposed above the lower pipe injector, the lower pipe injector housing configured to be coupled at a lower longitudinal end to a subsea wellhead, the lower pipe injector housing configured to be coupled at an upper longitudinal end to at least one of (i) a spacer spool disposed between the upper pipe injector housing and the lower pipe injector housing, and (ii) the lower longitudinal end of the upper pipe injector housing.

2. The system of claim 1 further comprising a template having a movable support affixed thereto, the movable support having at least one jack rotatable to orient a longitudinal axis of the at least one jack at a selected angle with reference to vertical.

3. The system of claim 2 wherein the template comprises an opening for receiving a conductor pipe therethrough at a selected angle maintained by the at least one jack.

4. The system of claim 2 wherein the upper pipe injector housing and the lower pipe injector housing are each mounted in a respective frame, the lower pipe injector housing frame affixable to the template at a selected angle determined by an extension length of the at least one jack.

5. The system of claim 4 wherein the upper pipe injector housing frame is configured to couple to the lower pipe injector housing frame.

6. The system of claim 1 further comprising a wiper disposed in the upper pipe injector housing above the upper pipe injector.

7. A method for performing well intervention, comprising:

placing a template comprising at least one axially rotatable jack on the bottom of a body of water;

lowering a conductor pipe to the template and supporting the conductor pipe at a selected inclination using the at least one jack;

inserting the conductor pipe into the sub-bottom to a selected depth below the bottom of the body of water;

drilling a wellbore for a surface casing from within the conductor pipe;

setting the surface casing in the wellbore at the selected inclination;

coupling a blowout preventer assembly to an upper end of the surface casing, a through bore of the blowout preventer assembly being oriented at the selected inclination; and coupling a spacer spool and an upper seal housing on top of the blowout preventer assembly, a through bore of the spacer spool and the upper seal housing having a through bore oriented at the selected inclination.

8. The method of claim 7 wherein the upper seal housing comprises a pipe injector disposed therein, the pipe injector in the upper seal housing operable to move wellbore intervention tools therethrough.

9. The method of claim 8 further comprising operating the pipe injector to move a wellbore intervention tool assembly along an interior of at least the surface casing while operating seals in the upper seal housing to exclude fluid in the interior of the surface casing from being discharged therefrom.

10. The method of claim 9 wherein the operating the pipe injector in the upper seal housing is performed to lift the wellbore intervention tool assembly out of the surface casing.

11. The method of claim 10 wherein the blowout preventer assembly comprises a pipe injector disposed in a common housing therein, the pipe injector in the common housing operable to move wellbore intervention tools therethrough.

12. The method of claim 11 further comprising operating the pipe injector in the common housing to move the wellbore intervention tools into the surface casing.

13. The method of claim 12 further comprising operating the pipe injector in the seal housing and the pipe injector in the common housing simultaneously to move the wellbore intervention tools.

14. The method of claim 12 wherein the wellbore intervention tools comprise a drilling tool assembly, and the moving the wellbore intervention tools comprises drilling a wellbore below the bottom of the surface casing.

15. The method of claim 9 further comprising wiping an exterior of the wellbore intervention tools above the pipe injector when the pipe injector is operated to move the wellbore intervention tools out of the surface casing.

16. The method of claim 7 further comprising disposing a wellbore intervention tool at a selected depth in the wellbore or in the surface casing, operating seals in the upper seal housing to sealingly engage the wellbore intervention tool, pumping a selected fluid through the wellbore intervention tool, and discharging existing fluid in the wellbore or the surface casing through a fluid discharge port in the upper seal housing.

17. The method of claim 7 further comprising coupling a drillable or dissolvable material plug to an end of the conductor pipe and drilling or dissolving the drillable or dissolvable material prior to drilling the wellbore for the surface casing.

18. The method of claim 7 further comprising extending the wellbore below a bottom end of the surface casing horizontally.

19. A method for performing well intervention, comprising:

placing a template comprising at least one axially rotatable jack on the bottom of a body of water;

lowering a conductor pipe to the template and supporting the conductor pipe at a selected inclination using the at least one jack;

inserting the conductor pipe into the sub-bottom to a selected depth below the bottom of the body of water;

drilling a wellbore for a surface casing from within the conductor pipe;

setting the surface casing in the wellbore at the selected inclination; and coupling a blowout preventer assembly to an upper end of the surface casing, a through bore of the blowout preventer assembly being oriented at the selected inclination;

wherein the inserting the conductor pipe comprises jetting the conductive pipe, and wherein the jetting is performed using a packer connected to a fluid line extending from the conductor pipe to the surface of the body of water.

20. The method of claim 7 further comprising coupling a drillable or dissolvable material plug to an end of the conductor pipe and drilling or dissolving the drillable or dissolvable material prior to drilling the wellbore for the surface casing.

21. The method of claim 7 further comprising extending the wellbore below a bottom end of the surface casing horizontally.

* * * * *